US005674408A

United States Patent [19]

Suzuki et al.

[11] Patent Number: 5,674,408

[45] Date of Patent: Oct. 7, 1997

[54] DEVELOPER CARRIER CAPABLE OF FORMING MICROFIELDS THEREON AND METHOD OF PRODUCING THE SAME

[75] Inventors: Koji Suzuki, Yokohama; Hiroshi Takashima, Yono; Shigekazu Enoki, Kawasaki; Naoki Iwata, Tokyo; Yuichi Ueno, Kawasaki, all of Japan

[73] Assignee: Ricoh Company, Ltd., Tokyo, Japan

[21] Appl. No.: 566,592

[22] Filed: Dec. 4, 1995

Related U.S. Application Data

[60] Continuation of Ser. No. 298,297, Sep. 1, 1994, abandoned, which is a division of Ser. No. 983,297, Nov. 30, 1992, abandoned, which is a continuation of Ser. No. 674,161, Mar. 25, 1991, abandoned.

[30] Foreign Application Priority Data

| | | | |
|---|---|---|---|
| Mar. 24, 1990 | [JP] | Japan | 2-74801 |
| Mar. 27, 1990 | [JP] | Japan | 2-30511 |
| Mar. 31, 1990 | [JP] | Japan | 2-87160 |

[51] Int. Cl.[6] ..... B44C 1/22

[52] U.S. Cl. ..... 216/39; 216/52; 430/137

[58] Field of Search ..... 216/8, 10, 11, 216/19, 34, 35, 39, 52

[56] References Cited

U.S. PATENT DOCUMENTS

| | | | |
|---|---|---|---|
| 4,034,709 | 7/1977 | Fraser et al. | 118/658 |
| 4,331,754 | 5/1982 | Stephan | 430/102 |
| 4,377,332 | 3/1983 | Tamura | 355/3 DD |
| 4,380,966 | 4/1983 | Isaka et al. | 118/651 |
| 4,508,052 | 4/1985 | Kohyama | 118/651 |
| 4,521,098 | 6/1985 | Hosoya et al. | 355/3 DD |
| 4,558,943 | 12/1985 | Patz | 355/3 DD |
| 4,576,463 | 3/1986 | Sakamoto et al. | 355/3 DD |
| 4,592,987 | 6/1986 | Mitsuhashi et al. | 430/102 |
| 4,599,290 | 7/1986 | Yoerger et al. | 430/108 |
| 4,788,570 | 11/1988 | Ogata et al. | 355/245 |
| 4,818,618 | 4/1989 | Okazaki et al. | 428/421 |
| 4,866,480 | 9/1989 | Hosoya et al. | 355/245 |
| 4,916,492 | 4/1990 | Hoshika et al. | 355/253 |
| 4,978,597 | 12/1990 | Nakahara et al. | 430/122 |

FOREIGN PATENT DOCUMENTS

| | | |
|---|---|---|
| 58-72968 | 5/1983 | Japan . |

*Primary Examiner*—William Powell

*Attorney, Agent, or Firm*—Oblon, Spivak, McClelland, Maier & Neustadt, P.C.

[57] ABSTRACT

A developer carrier capable of forming microfields on the surface thereof and a method of producing such a developer carrier. A great amount of sufficiently charged one-component developer is carried on the surface of the developer carrier by the microfields and transported to a developing station for developing an electrostatic latent image. The developer carrier has a simple structure and is easy and economical to produce.

24 Claims, 9 Drawing Sheets

DEVELOPER CARRIER CAPABLE OF FORMING MICROFIELDS THEREON AND METHOD OF PRODUCING THE SAME

This application is a continuation of application Ser. No. 08/298,297, filed on Sep. 1, 1994, now abandoned which is a divisional of Ser. No. 07/983,297 filed Nov. 30, 1992, now abandoned, which is a continuation of Ser. No. 07/674,161 filed Mar. 25, 1991, now abandoned.

BACKGROUND OF THE INVENTION

The present invention relates to a developing method and an apparatus therefor of the type causing a developer carrier to carry and transport a one-component developer to a developing region where the developer carrier faces an image carrier so as to develop a latent image electrostatially formed on the image carrier. More particularly, the present invention relates to a developer carrier capable of forming microfields thereon and a method of producing the same.

A developing device of the type using a powdery dry developer is extensively used with an electrophotographic copier, laser beam printer, facsimile transceiver or similar electrophotographic image forming equipment which electrostatically forms a latent image on an image carrier such as a photoconductive element and develops it by a developer. The powdery developer is available as a two-component developer which is the mixture of a toner and a carrier or a one-component developer which does not contain a carrier. Although a developing device using the two-component developer reproduces attractive images relatively stably, the carrier is apt to deteriorate and the mixture ratio of the toner and carrier is apt to change. This results in troublesome management of the apparatus and a bulky construction. For this reason, a developing device which uses the one-component developer free from the above problem is attracting much attention. The one-component developer is implemented with the toner only or with the toner and an auxiliary agent for controlling the polarity and amount of charge. The toner in turn is implemented as a magnetic toner containing magnetic powder therein or a non-magnetic toner which does not contain it. Since a magnetic body is usually opaque, a color image, whether it be full-color or multicolor, developed by the magnetic toner does not appear sharp. Therefore, it is preferable to use the one-component developer constituted by the non-magnetic toner when it comes to color images.

In a developing device implemented with a one-component developer, a developing roller or similar developer carrier carries the developer thereon and transports it to a developing region where the developer carrier faces an image carrier. In this region, the developer develops a latent image electrostatically formed on the image carrier. A prerequisite with this type of developing device is that a great amount of sufficiently charged toner be fed to the developing region in order to insure high quality images having predetermined density. When the magnetic toner is used, a sufficient amount of one-component developer may be deposited on the surface of the developer carrier by magnets. However, the non-magnetic one-component developer is immune to magnetism, so that transporting a great amount of developer to the developing region is difficult.

Various implementations have been proposed in the past for eliminating the above problem. For example, a developing device disclosed in Japanese Patent Laid-Open Publication No. 43767/1986 has a developer carrier covered with an insulative dielectric layer, and a sponge roller or similar developer supply member held in pressing contact with the dielectric layer. The developer carrier and the sponge roller are charged to opposite polarities by friction. A non-magentic one-component developer charged to the opposite polarity to the dielectric layer is electrostatically deposited on the dielectric layer and transported to a developing region. A drawback with this scheme is that the electric field developed in the vicinity of the surface of the dielectric layer is not intense enough to deposit a great amount of toner on the surface of the developer carrier and, therefore, the developer available in the developing region is short. In this condition, forming a developed image or toner image with high density is not easy. To eliminate this drawback, the developer carrier is moved at a speed which is twice or more than the moving speed of the image carrier. This, however, brings about another problem that the density of a solid image formed on the image carrier becomes unusually high in a trailing edge portion of the image with respect to the moving direction of the image carrier, resulting in poor image quality.

Another conventional developing device generates an electric field between the developer carrier and the image carrier in a direction for electrostatically transferring the non-magnetic one-component developer toward the developer carrier. Such an approach, however, also fails to deposit a sufficient amount of developer on the developer carrier.

Japanese Patent Laid-Open Publication No. 51841/1979 teaches another approach which uses a developer supply member for positively causing the non-magnetic developer to electrostatically deposit on the developer carrier. Specifically, after the developer carrier has moved away from the developing region, the non-magnetic one-component developer remaining thereon is scraped off. Then, the surface layer of the developer carrier is applied with a charge by corona discharge. The developer supply member positively and electrostatically deposits the non-magnetic developer on the charged surface of the developer carrier. With this approach, it is impossible to increase the amount of developer carried on the developer carrier and, therefore, to feed a great amount of toner to the developing region.

The developer carrier may be provided with undulations on the surface thereof so as to fill them with the non-magnetic one-component developer, as disclosed in Japanese Patent Laid-Open Publication No. 53996/1985. While such a configuration may be successful in increasing the amount of developer to reach the developing region, such a developer contains a substantial amount of toner whose charge is short and, therefore, cannot produce high quality images.

Further, Japanese Patent Publication No. 9711/1980 proposes a developing device having a developer carrier made up of a conductive support member, an insulating layer provided on the support member, and a conductive lattice member provided on the insulating member. The insulating layer is exposed to the outside through numerous openings formed through the lattice member. A voltage opposite in polarity to a developer is applied between the lattice member and the support member to generate microfields, so that a great amount of developer may be deposited on the surface of the developer carrier by the micro fields. However, such microfields are not attainable without resorting at least an exclusive external power source, resulting in a complicated construction. Other approaches for generating microfields are taught in U.S. Pat. No. 3,739,748 (Rittler et al), U.S. Pat. No. 3,645,618 (Lancia et al), U.S. Pat. No. 3,759,222 (Maksymiak et al), and "Microfield Donors for Touchdown Development" by P. G. Andrus et al, SPSE 2nd International Conference on Electrophotography, October 1973.

SUMMARY OF THE INVENTION

We have proposed an implementation for eliminating the problems particular to the conventional technologies in pending U.S. patent application Ser. No. 07/597,881 filed Oct. 12, 1990 now abandoned Apr. 27, 1992. The present invention is founded on this prior application.

It is therefore an object of the present invention to provide a developing method and an apparatus therefor capable of depositing a great amount of one-component developer on a developer carrier by use of numerous microfields and causing the developer carrier to transport it to a developing region for developing a latent image electrostatically formed on an image carrier.

It is another object of the present invention to provide a developer carrier capable of forming numerous micro fields thereon with a simple structure and a method of producing it easily and at low cost.

In accordance with the present invention, a method of producing a developer carrier for carrying a developer on the surface thereof where a number of microfields are developed comprises the steps of preparing a conductive base, roughening the surface of the conductive base, preparing a masking member having a number of small apertures, applying dielectric particles dispersed in a solvent to the roughened surface of the conductive base via the small apertures of the masking member, and polishing, after the dielectric particles have been hardened, the surface of the dielectric particles and the surface of the base, whereby the surface of the developer carrier is constituted by conductive bodies of the base and dielectric bodies constituted by the hardened dielectric particles.

Also, in accordance with the present invention, a method of producing a developer carrier for carrying a developer on the surface thereof where a number of microfields are developed comprises the steps of preparing a conductive base and a masking member having a number of small apertures, causing the masking member into close contact with the surface of the conductive base, applying an etching liquid to the surface of the conductive base via the apertures of the masking member to erode only surface portions of the conductive base which underly the apertures and thereby forming a number of small recesses, coating the surface of the conductive base with a dielectric substance to fill the number of recesses, and polishing the surface of the conductive base after the dielectric substance in the number of recesses has been hardened, whereby the surface of the developer carrier is constituted by conductive bodies of the conductive substrate and dielectric bodies constituted by the hardened dielectric substance.

Further, in accordance with the present invention, a method of producing a developer carrier for carrying a developer on the surface thereof where a number of microfields are developed comprises the steps of preparing a conductive base, roughening the surface of the conductive base, coating the roughened surface of the conductive base with a dielectric substance to thereby form a dielectric layer on the roughened surface, and smoothing, after the dielectric substance has been hardened, the surface of the dielectric layer, whereby the dielectric layer is not uniform in thickness on the surface of the developer carrier which the dielectric layer constitutes.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Preferred embodiments of the present invention will be described hereinafter which are implemented as a developing device of an electrophotographic copier belonging to a family 0f image forming equipment.

Figure 1:
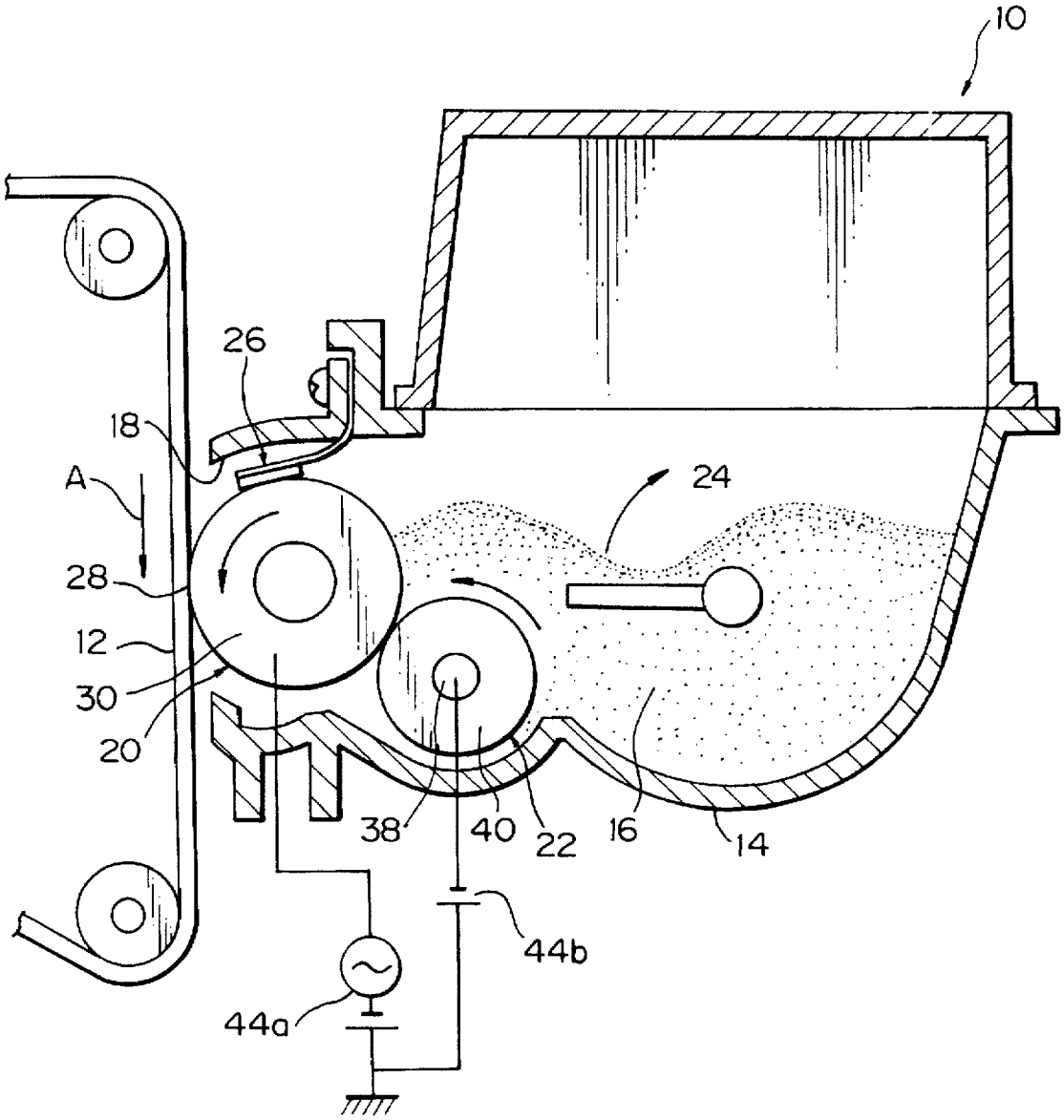
FIG. 1 is a section showing a first embodiment of the developing device in accordance with the present invention.
Figure 2:
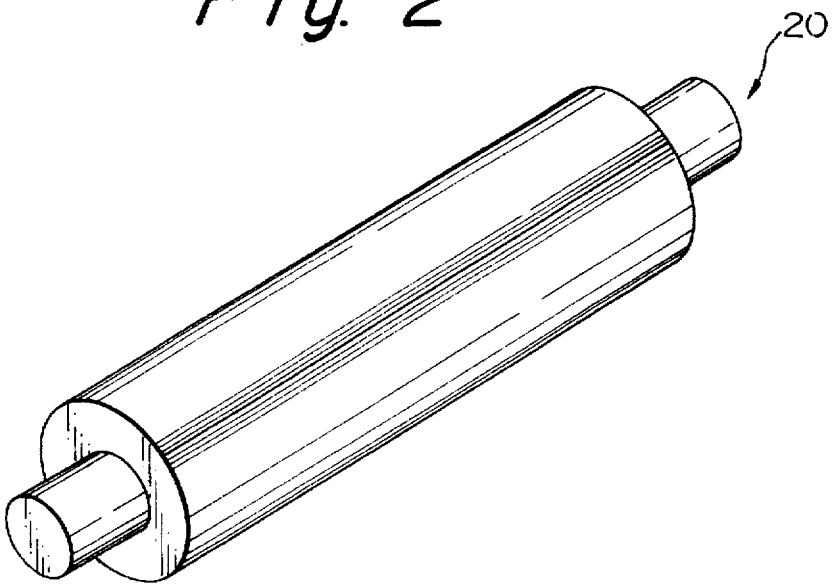
FIG. 2 is an external perspective view of a developing roller included in the embodiment.

Referring to FIG. 1 of the drawings, a first embodiment of the developing device in accordance with the present invention is shown and generally designated by the reference numeral 10. The developing device 10 is located to face an image carrier in the form of a photoconductive belt 12. The developing device 10 has a casing 14 which stores therein a one-component developer, or non-magnetic toner, 16. The developer 16 may or may not contain an auxiliary agent for controling the polarity and amount of charge. The toner is usually a polyester-, BMA-, polystyrene-, epoxy-, phenol- or similar resin-based composition. The specific volume resistivity of the toner ranges from about $10^7$ to $10^{12}$ Ω.cm, and this is also true with the other embodiments which will be described. A developing roller 20 is supported by a front and a rear walls, not shown, of the casing 14 and partly exposed to the outside through an opening 18 which is formed through the casing 14. The roller 20 faces the belt 12 and is rotatable counterclockwise as viewed in the figure and at a speed of 400 r.p.m, for example. FIG. 2 shows the roller 20 in a perspective view. The roller 20 is a mere example of a developer carrier and may be implemented as a belt, if desired. A toner supply roller 22 is also supported by the opposite side walls of the casing 14 and serves as a developer supply member. The toner supply roller 22 is rotated counterclockwise at a speed of, for example, 300 r.p.m in contact with the developing roller 20.

An agitator 24 is disposed in the casing 14 and rotated clockwise as viewed in FIG. 1 to agitate the toner 16 accommodated in the casing 14. In this configuration, the toner 16 is fed to the toner supply roller 22 while being agitated by the agitator 24. The toner supply roller 22 in turn conveys the developer 16 to the developing roller 20. During such transition, the toner 16 is charged by friction to a predetermined polarity, i.e., positive polarity opposite to the polarity of an electrostatic latent image in the illustrative embodiment. As a result, the toner 16 is electrostatically deposited on the periphery of the developing roller 20. This part of the construction and operation will be described specifically later. While the developing roller 20 transports the toner 16 deposited thereon, a doctor blade 26 regulates the toner 16 to a predetermined thickness. In this sense, the doctor blade 26 plays the role of a layer thickness regulating member. The toner 16 so regulated in thickness enters a developing region 28 where the developing roller 20 faces the belt 12. In this region 28, the toner is electrostatically transferred from the roller 20 to the belt 12 to develop a latent image which has been electrostatically formed on the belt 12. A part of the toner 16 having moved away from the developing region 28 without being transferred to the latent image is returned by the developing roller 20 to the toner supply roller 22. The developed image, or toner image, on the belt 12 is transferred therefrom to a paper sheet, not shown, and then fixed.

Figure 3:
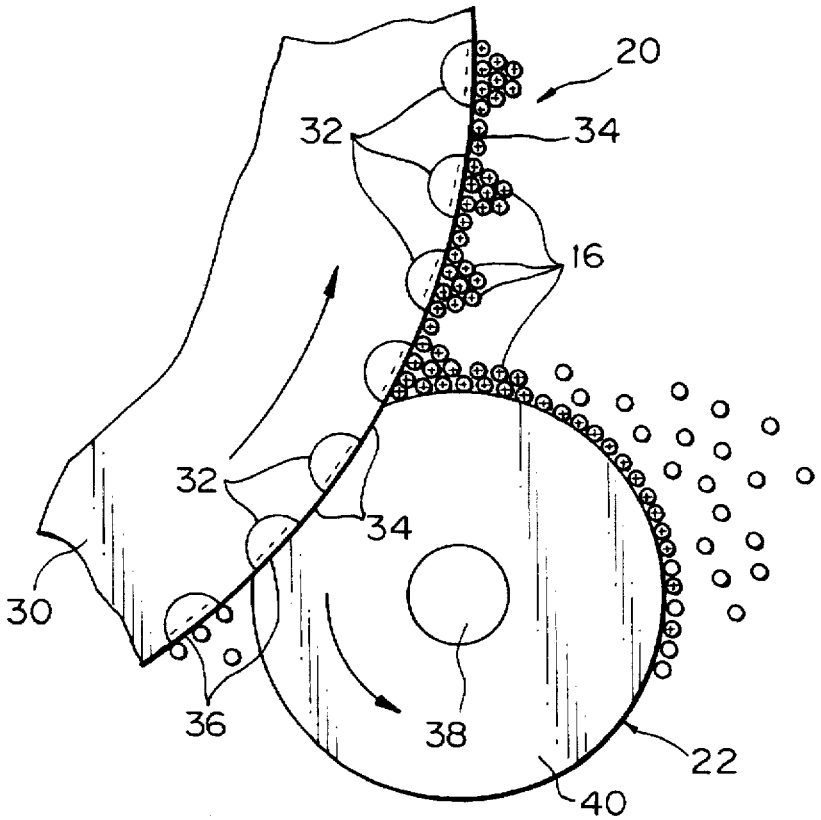
FIG. 3 is a view showing the structure of the developing roller and how a toner is deposited on the surface thereof.
Figure 4:
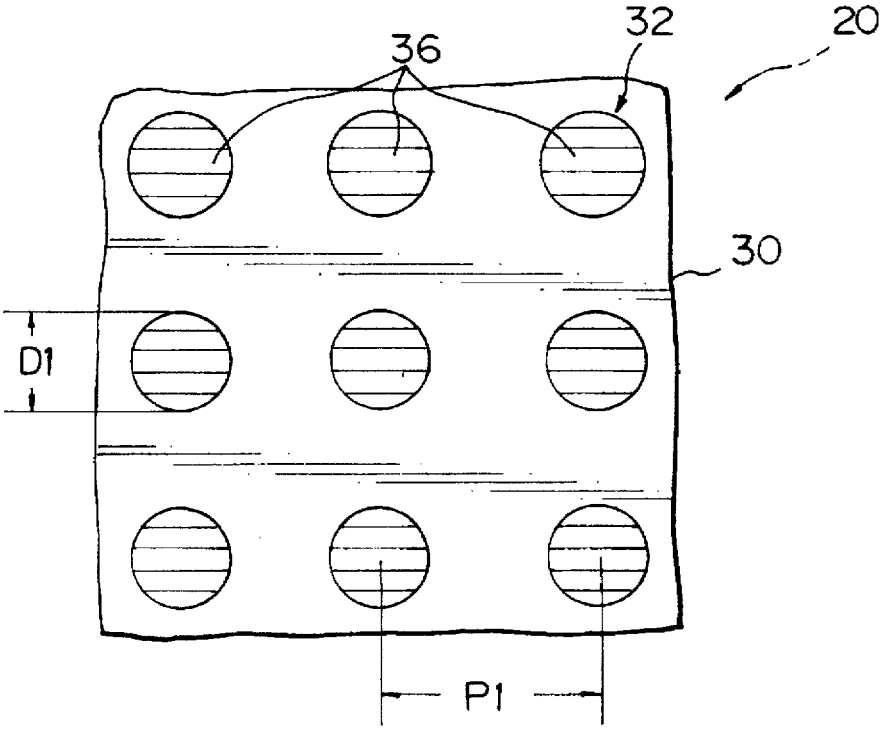
FIG. 4 is a plan view of dielectric bodies each being exposed to the outside on the surface of the developing roller.
Figure 5:
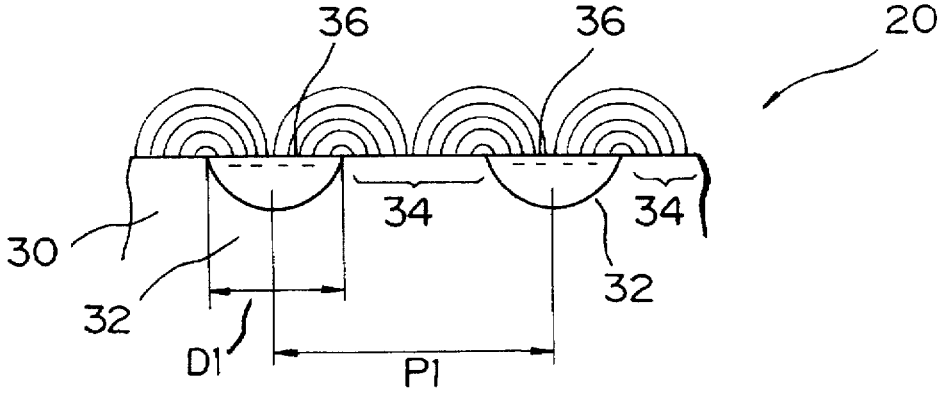
FIG. 5 is a view showing electric lines of force of microfields developed in the vicinity of the surface of the developing roller by the dielectric bodies.

As shown in FIG. 3, the developing roller 20 has a cylindrical base 30 made of aluminum, stainless steel or similar conductive material, and a great number of fine dielectric bodies 32 made of an insulating material. The dielectric bodies 32 are distributed on and affixed to the periphery of the conductive base 30. Hence, the surface of the base 30, i.e., conductive portions 34 and the surfaces 36 of the dielectric bodies 32 are exposed to the outside either in a regular pattern or irregularly. The shape and size of the individual dielectric bodies 32 may be suitably selected. For example, assuming that the surfaces 36 of the dielectric bodies 32 exposed to the outside are circular, each dielectric body 32 may have a diameter D1 of 10 to 500 μm, preferably 50 to 300 ∞m, and the center-to-center distance P1 between nearby dielectric bodies 32 may be 100 to 500 μm, as shown in FIGS. 4 and 5. On the other hand, assuming that the surfaces 36 of the dielectric bodies 32 are rectangular, at least one side thereof may have a length of 10 to 500 μm. The ratio of the area of the conductive portions 34 of the base 30 to the overall area of the developing roller 20 is selected to be 30 to 70%. When the developer carrier is implemented as a belt, a great number of such fine dielectric bodies will also be affixed to the surface of the conductive base of the belt. The dielectric bodies 32 are made of a dielectric material which will be charged by friction to the polarity opposite to that of the toner 16, i.e., to the negative polarity in the illustrative embodiment.

The toner supply roller 22 contacting the developing roller 20 is made of a material which frictionally charges the dielectric bodies 32 of the developing roller 20 in contact therewith to the polarity opposite to that of the toner 16, i.e., to the negative polarity in the illustrative embodiment. In the specific configuration shown in FIGS. 1 and 3, the toner supply roller 22 has a conductive core member 38 and a cylindrical foamed body (e.g. foamed polyurethane) 40 provided on the core member 38. The foamed body 40 is held in pressing contact with the developing roller 20 while elastically deforming itself. When the toner supply roller 22 has such a structure, the foamed body 40 may be formed of a material which negatively charges the dielectric bodies 32 by friction as mentioned above.

The developing device 10 having the above construction will be operated as follows.

The portion of the surface of the developing roller 20 moved away from the developing region 28 is caused into contact with the surface of the toner supply roller 22 as the roller 20 is 25 rotated, as stated earlier. Then, the toner 16 remaining non-transferred on the developing roller 22 is scraped off by a scavenging force which the toner suppler roller 22 exerts thereon. At the same time, the dielecric bodies 32 of the developing roller 20 are charged to the negative polarity which is opposite to the polarity of the toner 16 by the toner supply roller 22. At this instant, an electrostatic residual image ascribable to the latent image formed on the belt 12 may remain on the dielectric bodies 32 having moved away from the developing region 28. Nevertheless, since the dielectric bodies 32 are charged substantially to saturation by the friction thereof with the toner supply roller 22, such a residual image is erased to initialize the developing roller 20.

On the other hand, as shown in FIG. 3, the toner 16 contacting and driven by the toner supply roller 22 toward the developing roller 20 is charged to the positive polarity by friction thereof with the roller 22. On reaching the developing roller 20, the toner 16 is charged more intensely to the positive polarity in frictional contact with the roller 20, particularly the dielectric elements 32, and thereby caused to electrostatically deposit on the periphery of the roller 20. In this instance, the dielectric bodies 32 of the developing roller 20 have been frictionally charged to the negative polarity and are surrounded by the conductive portions 34, so that the negative charge has been selectively deposited only on the dielectric bodies 32. Hence, as shown in FIG. 5, microfields are developed between the negatively charged dielectric bodies 32 and the conductive portions 34 with the result that almost countless microfields are formed in close proximity to the surface of the developing roller 20. More specifically, assuming electric lines of force representative of a condition of an electric field, they are formed in the space adjoining the surface of the developing roller 20, as represented by arcuate lines in FIG. 5. Consequently, microfields are generated between the dielectric bodies 32 and the conductive portions Since the dielectric bodies 32 and the conductive portions 34 neighbor each other and each has an extremely small area, the microfields each is extremely intense due to the so-called edge effect or the fringing effect (peripheral field effect). The positively charged toner 16 is strongly attracted by the dielectric bodies 32 due to such microfields and, therefore, firmly retained on the developing roller 20 in a great amount. At this instance, the toner 16 has been strongly charged by the friction of the rollers 22 and 20. This, coupled with the fact that the toner 16 is retained on the roller 20 by the intense microfields, a great amount of toner 16 bearing an intense charge is carried on the roller 20. When the the toner 15 on the developing roller 20 is regulated in thickness by the doctor blade 26 which is made of urethane, for example, the sufficiently charged part of the toner 16 is firmly retained on the roller 20 by the microfields while the weakly charged part is removed by the doctor blade 26. As a result, only the intensely charged toner 16 is transported in a great amount to the developing region 28 so as to develop the latent image formed on the belt 12. This is successful in providing the resulting toner image with high density and in freeing the background of the image from contamination. The amount of charge on the toner 16 is selected to he about 5 to 20 μc/g, preferably 10 to 15 μc/g in order to enhance the sharpness of the toner image.

While the microfields are shown in FIG. 5 as being generated over the entire surface of the developing roller 20, electric fields other than the microfields may exist among the microfields. In any case, the microfields do exist and allow a great amount of toner 16 to be deposited on the developing roller 20.

Despite that the toner 16 has to be deposited on a paper sheet in an amount of about 0.4 to 0.5 mg/cm$^2$, a conventional developing apparatus can deposite only an about 0.1 to 0.3 mg/cm$^2$ of toner on the surface of the developing roller 20 having passed the doctor blade 26. It has been customary, therefore, to rotate the developing roller 20 at a speed which is three to four times higher than the speed of the photoconductive drum 12, thereby increasing the amount of toner 16 to be transported to the developing station 28. This, however, brings about a problem that the intensity of a solid image formed on the drum 12 is locally increased to an unusual degree only in the trailing edge portion thereof with respect to the direction of rotation of the drum 12, resulting in poor image quality. Such an irregular density distribution may be eliminated if the developing roller 20 is rotated at the same or substantially the same speed as the drum 12. Then, however, the toner 16 has to be deposited on the developing roller 20 in an amount of about 0.8 to 1.2 mg/cm$^2$ and cannot be done so by the conventional developing apparatus.

By contrast, the illustrative embodiment can eliminate the contamination of the background of a toner image and transport a great amount of toner (e.g. 0.8 to 1.2 mg/cm$^2$) having been charged to about 5 to 20 (preferably 10 to 15) μc/g to the developing region 28. This allows the developing roller 20 to be rotated at the same or substantially the same speed as the drum 12.

While the embodiment effects non-contact type development at the developing region 28, it is also practicable with contact type development. If desired, bias voltages such as DC, AC, DC-superposed AC or pulses may be applied from the power sources **44*a* and 44*b* to the developing roller 20 and toner supply roller 22 so as to further enhance the quality of toner images. Further, while the dielectric bodies 32 of the embodiment are charged to the opposite polarity to the toner 16, they may be charged to the same polarity as the toner 16 to deposit a great amount of toner on the developing roller 20**.

A specific procedure for fabricating the developing roller 20 described above is as follows.

Figure 6:
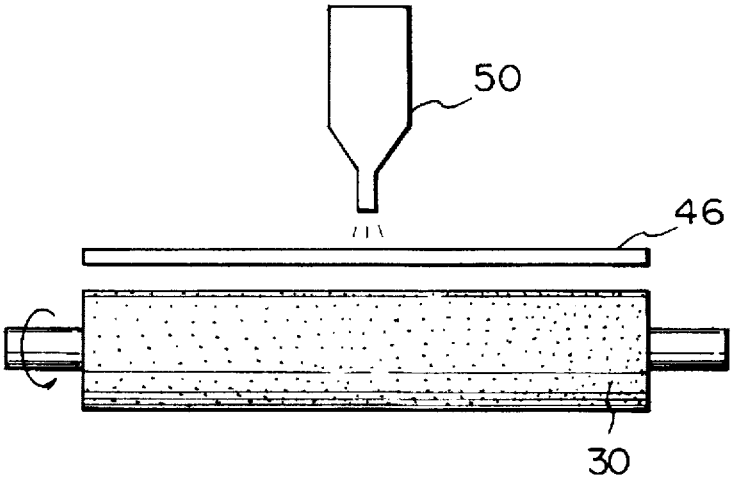
FIGS. 6, and 7A to 7C are views showing a specific procedure for fabricating the developing roller.
Figure 7A:
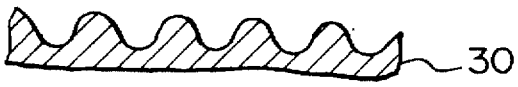
Figure 8:
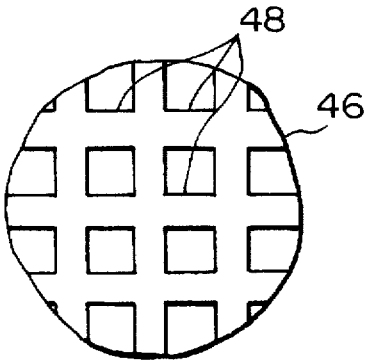
FIG. 8 shows a masked surface used during fabrication of an embodiment of the present invention.

As shown in FIG. 6, a cylindrical conductive base 30 which is the material of the roller 20 is prepared. The conductive base 30 is made of Al, Cu, Fe or similar metal. The surface of the base 30 is roughened by sand blasting or similar technology to the surface roughness of about 10 to 100 μm, for example. FIG. 7A shows the so roughened surface of the base 30 in an enlarged scale. Then, as also shown in FIG. 6, a masking member 46 is located above the base 30. As shown in an enlarged view in FIG. 8, the masking member 46 is implemented as a sheet having a great number of small apertures 43. These apertures 48 each is so sized as to pass only the dielectric bodies 32, FIGS. 3 and 4, therethrough, e.g. 10 to 500 μm each side.

Figure 7B:
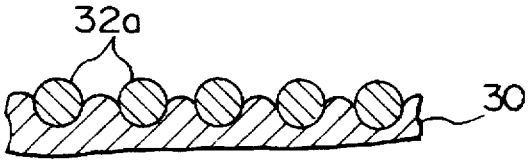
Figure 7C:
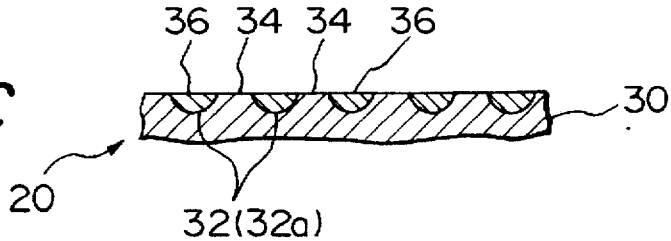

A liquid prepared by dispersing a great number of dielectric particles in, for example, an organic solvent is sprayed onto the roughened surface of the base 30 through the masking member 46 by a spraying device 50. FIG. 6. At this instant, the base 30 is rotated so that the liquid may be applied to the entire periphery of the base 30. As a result, only the dielectric particles passed the apertures 48 of the masking member 46 are applied to the base 30, as shown in FIG. 7B. As FIG. 7B indicates, the dielectric particles labeled **32*a* are surely retained on the base 30 due to the roughened surface of the base 30. In addition, the particles 32*a* are uniformly distributed over the entire surface of the base 30 due to the masking member 46. Subsequently, the solvent is hardened with or without hot air being blown thereonto. The so dried surface of the base 30 is buffed or otherwise polished, as shown in FIG. 7C. The resulted developing roller 20 has on its surface the conductive portions 34 of the base 30 and the surfaces 36 of dielectric bodies 32 which are constituted by the dielectric particles 32*a***.

Even when the developing roller 20 is replaced with a developer carrier in the form of a belt, the specific procedure described above is practicable in the same manner only if the conductive base 30 is implemented as a conductive sheet.

Figure 9:
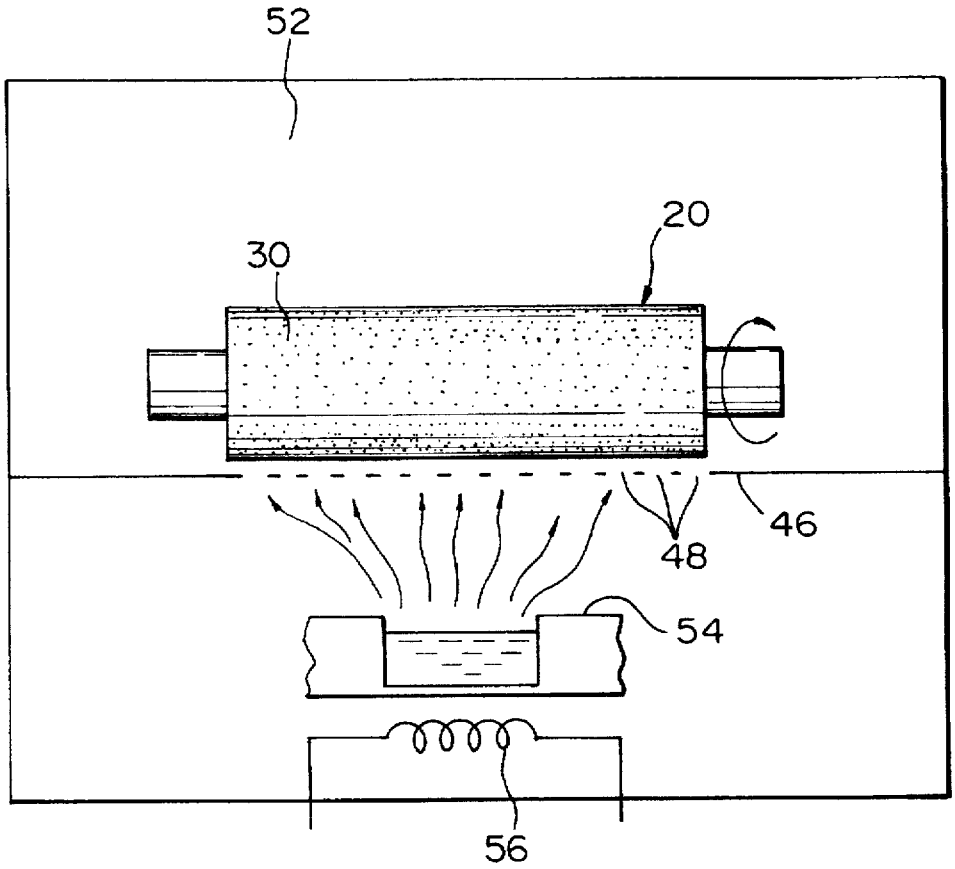
FIG. 9 is a view showing another specific procedure for fabricating the developing roller.

Referring to FIG. 9, another specific procedure for producing the developing roller 20 will be described. Again, the conductive base 30 is made of Al, Cu, Fe or similar metal and is implemented as a roller or a belt, as the case may be. The surface of the base 30 is roughened by sand blasting or similar technology to the surface roughness of about 10 to 100 μm, for example. Dielectric particles **32*a* dispersed in a solvent are deposited on the toughened surface of the base 30 by evaporation. Specifically, as shown in FIG. 9, the base 30 whose surface has been toughened is placed in a weakly evacuated furnace 52 together with a vessel 54 which is filled with the dispersion of dielectric particles 32*a*. Then, a heater 56 heats the vessel 54 to evaporate the solvent together with the dielectric particles 32*a*. The resulted vapor is applied to the conductive base 30 through the masking member 46. Consequently, the dielectric particles 32*a* each having a predetermined size are deposited on the base 30, as in FIG. 7B. At this instant, the base 30 is continuously rotated for the previously mentioned purpose. After the surface of the base 30** has been dried, it is buffed or otherwise polished to have the configuration shown in FIG. 7C.

The procedure described above with reference to FIG. 9 deposits the dielectric particles **32*a* by evaporation on the surface of the conductive base 30. This is successful in applying the dielectric particles to a uniform thickness on the base 30 and causing the surface portions 36 of the dielectric bodies 32 and the conductive portions 34** to appear in a predetermined ratio on the entire periphery of the developer carrier. Such a procedure is simple and positive.

Figure 10:
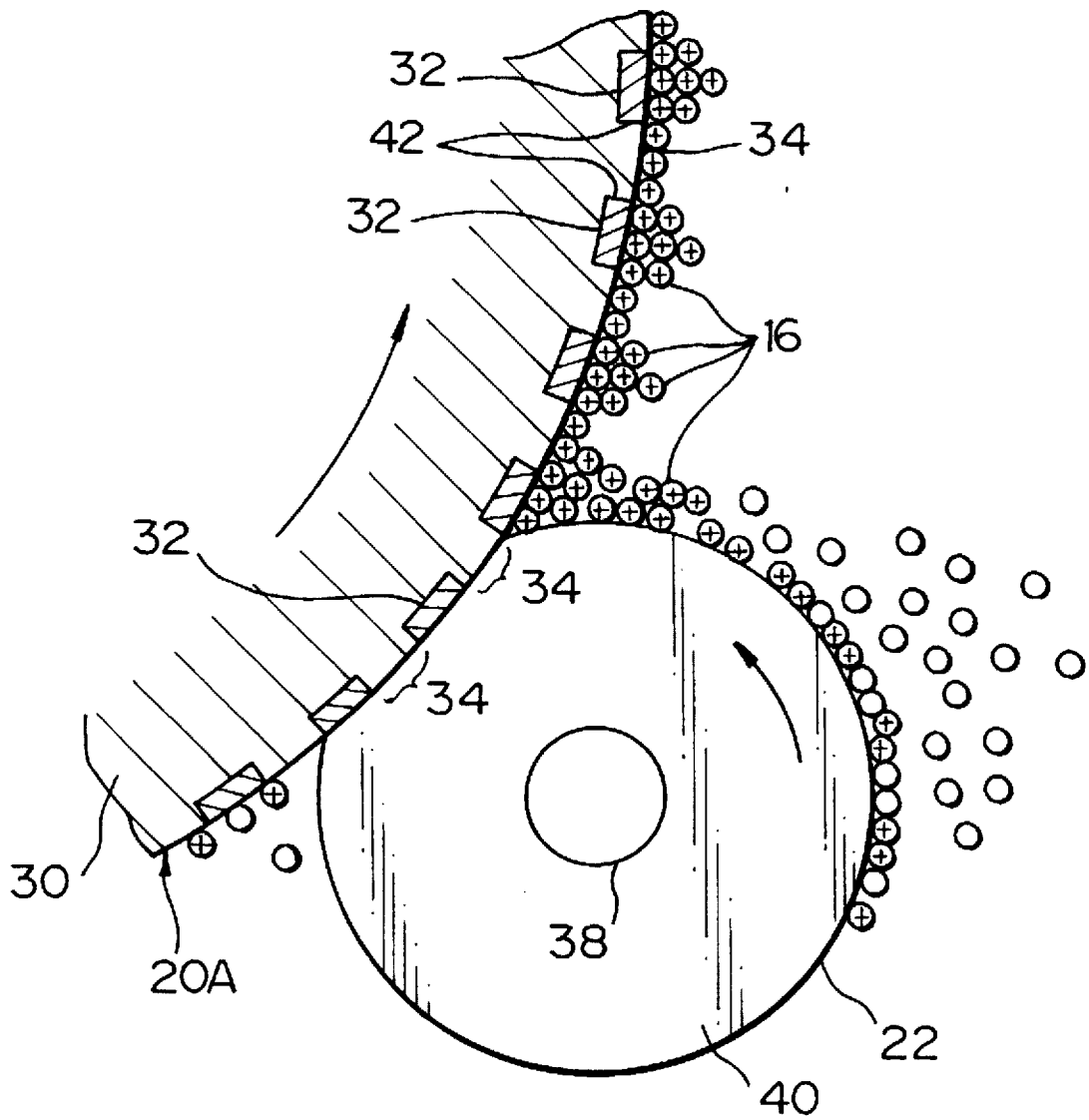
FIG. 10 is a view showing a developing roller representative of a second embodiment of the present invention together with toner particles deposited thereon.

Referring to FIG. 10, a developing roller 20A representative of an alternative embodiment of the present invention is shown. The developing roller 20A is a modified form of the developing roller 20. As shown, the developing roller 20A has a great number of rectangular recesses 42 in the surface thereof, while the dielectric bodies 32 are buried and firmly retained in the recesses 42. Again, the surfaces 36 of the dielectric bodies 32 and the conductive portions 34 appear on the surface of the developing roller 20A in a regular or irregular distribution. As shown in the figure, the dielectric bodies 32 retained in the rectangular recesses 42 each has a rectangular section in a direction perpendicular to the surface of the developing roller 20A.

Figure 11A:
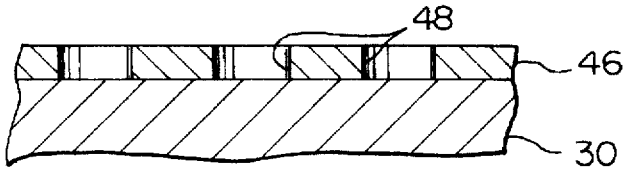
FIGS. 11A to 11D and 12 are views showing a specific procedure for fabricating the developing roller shown in FIG. 10.
Figure 11B:
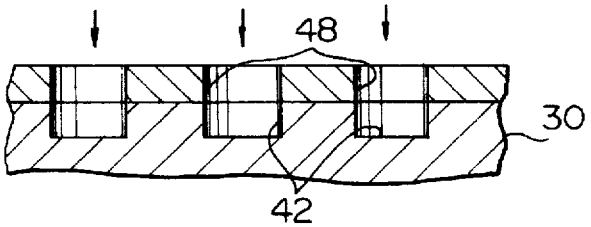
Figure 12:
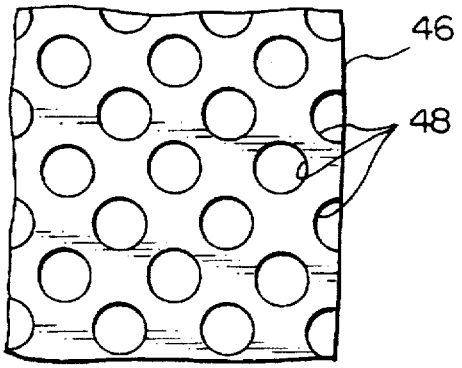

A specific procedure for fabricating the developing roller 20A will be described. First, a cylindrical conductive base 30 which is the material of the roller 20A is prepared, as in the first embodiment. As shown in FIG. 11A, a masking member 46 is applied to the entire periphery of the base 30. As shown in an enlarged scale in FIG. 12, the masking member 46 is implemented as a sheet having a great number of small apertures 48 and is made of a material which is erosion-resistant against an etching liquid. Then, an etching liquid is applied to the base 30 via the masking member 46. The etching liquid passed the apertures 48 of the masking member 46 erode only the surface portions of the base 30 which underly the apertures 48. As a result, a great number of small recesses 42 are formed in the entire surface of the base 30, as shown in FIG. 11B.

Figure 11C:
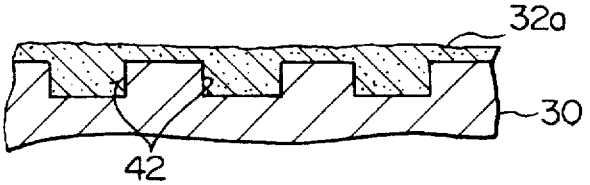
Figure 11D:
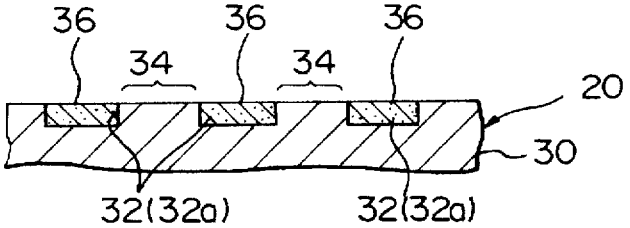

Thereafter, the masking member 46 is removed from the base 30, and then the base 30 is coated with a dielectric substance such as resin 32*a* to fill the recesses 42, as shown in FIG. 11C. The base 30 with such a dielectric coating 32*a* is dried and then polished, as shown in FIG. 11D. The resulted developing roller 20A has the small surfaces 36 of dielectric bodies 32 and the conductive bodies 34 appearing together on the surface thereof. This kind of method is also simple and economical. In addition, the surface 36 of each dielectric body 32 has accurate dimensions since the dielectric substance 32*a* is filled in the recesses 42 matching the apertures 48 in configuration Each aperture 48 of the masking member 46 shown in FIG. 11A, i.e., each recess 42 formed in the conductive base 30 has a size corresponding to the area of the surface portion 36 of the desired dielectric body 32. The size of each recess 42 and the distance between nearby recesses 42 are open to choice. While the apertures 48 are shown as being circular, they may have any other suitable configuration such as square or triangle. Further, the apertures 48 may be provided in a regular pattern or an irregular pattern, as desired. Moreover, the small recesses 42 may be replaced with one or more elongate channels each having a small width.

Again, the procedure described with reference to FIGS. 11A to 11D are similarly practicable with a developer carrier implemened as a belt.

Figure 13:
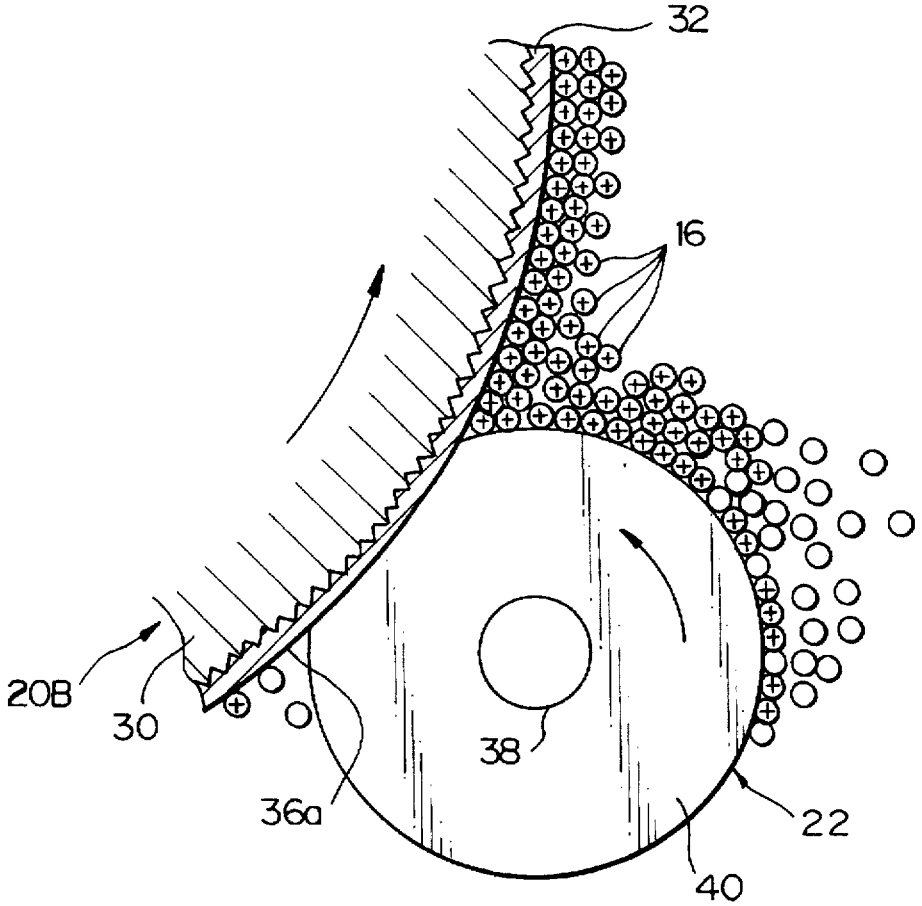
FIG. 13 is a view similar to FIG. 10, showing a developing roller representative of a third embodiment of the present invention.
Figure 14:
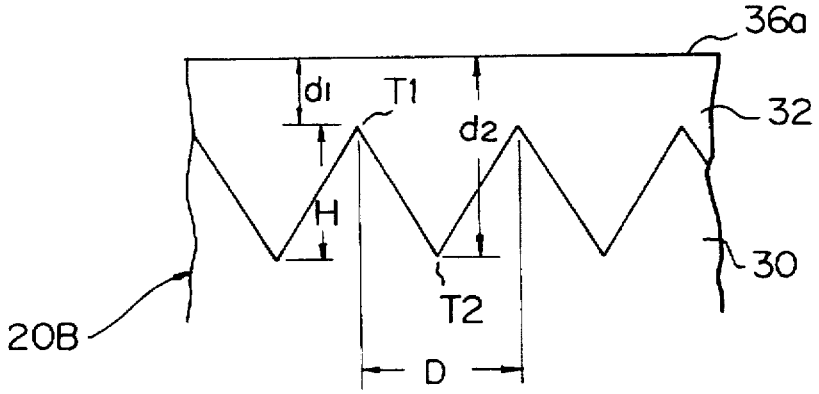
FIG. 14 schematically shows the surface portion of the developing roller shown in FIG. 13.

Referring to FIGS. 13 and 14, another alternative embodiment of the present invention is shown. As shown, a developing roller, generally 10B, also has the cylindrical conductive base 30 made of Al, Cu, Fe or similar metal. The dielectric layer 32 is deposited on the periphery of the base 30 and constituted by an insulator. The base 30 is provided with small undulations on the surface thereof, while the dielectric layer 32 has a smooth surface 36*a*. The undulations may be formed by, for example, roughening the surface of the base 30. In this configuration, the thickness of the dielectric layer 32 differs from one portion to another in association with the small undulations of the base 30. Specifically, as shown in FIG. 14, the dielectric layer 32 has a particular thickness $d_1$ between the top T1 of a projection of the undulations and the surface 36*a* thereof and has a different thickness $d_2$ between the bottom T2 of a recess of the undulations and the surface 36*a*. In this manner, the thickness of the dielectric layer 32 varies either randomly or regularly over the entire dielectric layer 32.

Figure 15:
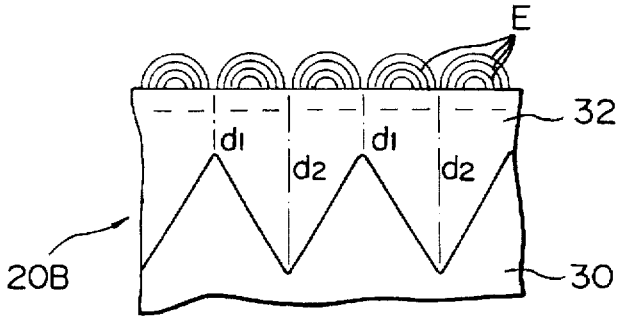
FIG. 15 is a view similar to FIG. 14, showing the electric lines of force of microfields developed on the surface of the developing roller.

Only microfields will sometimes be developed on the surface of the developing roller 20B, as shown in FIG. 15, or electric fields other than closed electric fields will sometimes be developed together with closed electric fields. In any case, due to the presence of closed electric fields, the intensity is increased to allow the roller 20B to carry a great amount of toner thereon.

To optimize the charge and amount of the toner carried on the developing roller 20B, it is preferable that the dielectric layer 32 be 5 to 500 μm thick and the ratio of the greater thickness $d_2$ to the smaller thickness $d_1$, FIG. 14, be greater than 2 ($d_2 \geqq 2 \times d_1$). Likewise, as shown in FIG. 14, the undulations of the base 30 should advantageously be configured such that the height H of each projection and the distance D between the tips of nearby projections be 5 to 100 μm each.

Figure 16A:
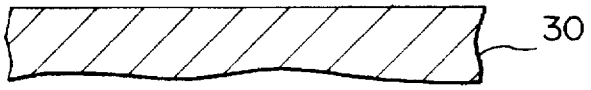
FIGS. 16A to 16D are views demonstrating a specific procedure for fabricating the developing roller shown in FIG. 13.
Figure 16B:
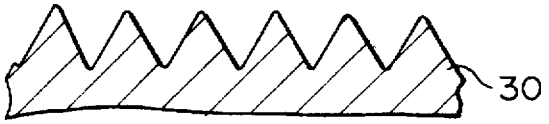

A specific procedure for fabricating the developing roller 20B is as follows. As shown in FIG. 16A, the conductive base 30 which is the material of the roller 20B is produced by machining. The surface of the base 30 is roughened by sand blasting or by spraying molten metal by air to form undulations, as shown in FIG. 16B. The undulations are dimensioned such that the height of the tip of each projection and the distance between tips of nearby recesses are about 5 to 100 μm each. Regarding spraying of molten metal, it is sprayed onto the surface of the base 30 by air and then caused to solidify to form small undulations on the base 30. Since spraying allows the molten metal itself to form the surface of the conductive base 30, use may be made of an insulative base, if desired. In such a case, when the developing roller 20B is used, the metal layer produced by spraying may be connected to ground, or a given bias voltage may be applied to the metal layer.

Figure 16C:
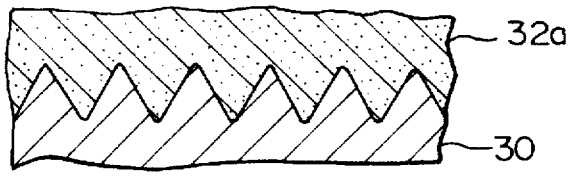
Figure 16D:
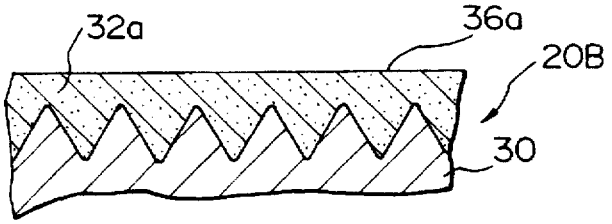

As shown in FIG. 16C, the roughened surface of the base 30 is coated with the dielectric substance such as fluoric resin 32*a* to fully bury the undulations and then dried. Regarding the dielectric substance 32*a*, Lumifron LF200 available from Asahi Glass (Japan) may be used. Specifically, such a substance may be applied to the roughened surface of the base 30 by spray coating and then dried at 100° C. for 30 minutes. Finally, the surface of the hardened dielectric substance 32*a* is machined or polished in such a manner as to prevent the conductive surface of the base 30 from being exposed, as shown in FIG. 16D. The resulted dielectric layer 32 has a substantially smooth surface and a non-uniform thickness distribution.

The procedure described above with reference to FIGS. 16A to 16D is similarly applicable even to a developer carrier implemented as a belt if the conductive roller 30 is replaced with a conductive sheet.

If desired, the regular or irregular undulations on the conductive base 30 may be formed by knurling, for example, in place of sand blasting or spraying of molten metal described above.

Various modifications will become possible for those skilled in the art after receiving the teachings of the present disclosure without departing from the scope thereof.

What is claimed is:

1. A method of producing a developer carrier for carrying a developer on a surface thereof where a number of microfields are developed, comprising the steps of:

(a) preparing a conductive base;

(b) roughening a surface of said conductive base;

(c) preparing a masking member having a number of small apertures;

(d) applying dielectric particles dispersed in a solvent to said roughened surface of said conductive base via said small apertures of said masking member; and (e) polishing, after said dielectric particles have been hardened, surfaces of said dielectric particles and said surface of said base, wherein said surface of said developer carrier is constituted by conductive bodies of said base and dielectric bodies constituted by said hardened dielectric particles, wherein said dielectric bodies are uniformly distributed along said conductive base and have a center-to-center distance between adjacent dielectric bodies equal to 0.1 mm to 0.5 mm.

2. A method as claimed in claim 1, wherein said conductive base prepared in step (a) comprises a metallic material in the form of a roller.

3. A method as claimed in claim 1, wherein said conductive base prepared in step (a) comprises a metallic material in the form of a sheet.

4. A method as claimed in claim 1, wherein step (b) comprises sand blasting.

5. A method as claimed in claim 1, wherein step (d) comprises moving said surface of said conductive base to apply said dielectric particles to the entire surface of said base.

6. A method as claimed in claim 1, wherein step (d) comprises spraying said dielectric particles.

7. A method as claimed in claim 1, wherein step (d) comprises applying said dielectric particles by evaporation.

8. A method as claimed in claim 1, further comprising the step of (f) drying said solvent by hot air after step (d).

9. A method as claimed in claim 1, further comprising the step of (f) drying said solvent in air after step (f).

10. A method of producing a developer carrier for carrying a developer on a surface thereof where a number of microfields are developed, comprising the steps of:

(a) preparing a conductive base and a masking member having a number of small apertures;

(b) causing said masking member into close contact with a surface of said conductive base;

(c) applying an etching liquid to said surface of said conductive base via said apertures of said masking member to erode only surface portions of said conductive base which underlie said apertures for forming a number of small recesses;

(d) coating said surface of said conductive base with a dielectric substance to fill said number of recesses; and (e) polishing said surface of said conductive base after said dielectric substance in said number of recesses has been hardened, wherein said surface of said developer carrier is constituted by conductive bodies of said conductive substrate and dielectric bodies constituted by said hardened dielectric substance adjacent said dielectric bodies which are uniformly distributed along said conductive base and have a center-to-center distance of 0.1 mm to 0.5 mm.

11. A method as claimed in claim 10, wherein said conductive base prepared in step (a) comprises a metallic material in the form of a roller.

12. A method as claimed in claim 10, wherein said conductive base prepared in step (a) comprises a metallic material in the form of a sheet.

13. A method according to claim 1, wherein said number of small apertures form a regular array of apertures.

14. A method according to claim 13, wherein said regular array of apertures comprise V-shaped apertures.

15. A method according to claim 13, wherein said regular array of apertures comprise rectangular apertures.

16. A method according to claim 10, wherein said number of small apertures form a regular array of apertures.

17. A method according to claim 16, wherein each of said number of small apertures have rectangular openings.

18. A method according to claim 16, wherein each of said number of small apertures have circular openings.

19. A method for producing a developer carrier, said developer carrier for carrying a developer on a surface thereof via electrostatic attraction between particles of said developer and microfields on the surface of said developer carrier, comprising the steps of:

(a) preparing a conductive base;

(b) roughening a surface of said conductive base;

(c) providing a masking member comprising a plurality of small apertures and masking the roughened surface of said conductive base with said masking member; and (d) applying dielectric particles to the conductive base, adjacent bodies of said particles which are uniformly distributed along said conductive base and have a center-to-center distance of 0.1 mm to 0.5 mm through said plurality of small apertures.

20. A method according to claim 19, wherein said step of applying further comprises the steps of:

preparing a dispersion of dielectric particles in a solvent and applying the dispersion to the masking member to provide dielectric particles to the roughened surface of said conductive base through said small apertures of said masking member; and hardening the dielectric particles that have been applied to the roughened surface of the conductive base.

21. A method according to claim 19, wherein said plurality of small apertures comprise a regular array of identically shaped apertures.

22. A method of producing a developer carrier, said developer carrier for carrying a developer on a surface thereon via electrostatic attraction of the developer by microfields that are generated at the surface of the developer carrier, comprising the steps of:

(a) preparing a conductive base;

(b) preparing a masking member having a number of small apertures;

(c) masking a surface of the conductive base by placing said masking member adjacent to said surface of said conducting base;

(d) applying an etching liquid to the regions of said surface of said conducting base which are exposed through the small apertures of said masking member to thereby form small recesses corresponding to the small apertures;

(e) moving the masking member away from said surface or the conducting base and then coating said surface of the conductive base with a dielectric substance forming adjacent dielectric bodies which are uniformly distributed along said conductive base and have a center-to-center distance of 0.1 mm to 0.5 mm; and (f) polishing the surface that is formed by the coating of the dielectric substance.

23. A method according to 22, wherein said small apertures comprise a regular array of identically shaped apertures.

24. A method according to claim 22, wherein said dielectric substance completely covers said surface of said conductive base.

* * * * *